US006215108B1

(12) United States Patent
Butcher et al.

(10) Patent No.: US 6,215,108 B1
(45) Date of Patent: Apr. 10, 2001

(54) MULTIPLE ELECTRIC ELEMENT MOUNTING SYSTEM

(75) Inventors: Ronald G. Butcher, Plainfield; Raymond A. Rust, Jr., Gosport, both of IN (US); David C. Sherrod, Dandridge, TN (US); Avinash N. Patel, Brownsburg, IN (US)

(73) Assignee: Carrier Corporation, Carrier World Hdqtrs., Farmington, CT (US)

( * ) Notice: Subject to any disclaimer, the term of this patent is extended or adjusted under 35 U.S.C. 154(b) by 0 days.

(21) Appl. No.: 09/606,764

(22) Filed: Jun. 29, 2000

(51) Int. Cl.[7] ..... H05B 3/06

(52) U.S. Cl. ..... 219/537; 219/536; 338/304; 338/319

(58) Field of Search ..... 219/537, 536, 219/532; 338/315, 318, 319, 304, 305

(56) References Cited

U.S. PATENT DOCUMENTS

| | | | | |
|---|---|---|---|---|
| 5,895,597 | * | 3/1999 | Sherrill | 219/536 |
| 5,954,983 | * | 9/1999 | Holmes | 219/536 |
| 6,020,577 | * | 2/2000 | Barker | 219/537 |

* cited by examiner

*Primary Examiner*—Teresa Walberg
*Assistant Examiner*—Vinod D Patel
(74) *Attorney, Agent, or Firm*—Wall Marjama & Bilinski

(57) ABSTRACT

An electric element mounting system including a housing and at least one heating element. Each element includes a frame having a longitudinal axis and a distal end, a heating coil and a wire terminal for electrically and mechanically coupling the element to the front panel. A substantially planar mounting bracket is located within the housing; the bracket including at least one aperture. The bracket is located within the housing and placed in a plane perpendicular to the longitudinal axis of the frame so that the distal end is placed through the aperture to mount the element upon the bracket.

16 Claims, 3 Drawing Sheets

MULTIPLE ELECTRIC ELEMENT MOUNTING SYSTEM

BACKGROUND OF THE INVENTION

The present invention relates to electrical resistance heaters and assemblies and more particularly relates to a mounting system used to mount electrical heating elements.

Electric resistance heating assemblies of the type having a resistance element connected to a source of electrical power and mounted on a suitable support structure are used in various applications. For example, such assemblies may be used to independently provide heat for a space or room. Alternatively, such assemblies may be incorporated into a larger piece of equipment, such as an air conditioning unit, to provide warm air when required.

Electric resistance heating assemblies are well known in the art. For instance, U.S. Pat. No. 4,528,441, which is owned by a common assignee of the present invention and which is incorporated in its entirety herein by reference, describes electrical insulators used in electrical resistance heating assemblies. Further, U.S. Pat. No. 4,827,602, which is owned by a common assignee and which is incorporated in its entirety herein by reference, describes an electric heater assembly fixture and a method of use for the same. In addition, U.S. Pat. No. 3,952,409, which is also owned by the common assignee and which is incorporated in its entirety herein by reference, describes a method of manufacturing a support structure for an electric heating assembly that includes a plurality of heating elements.

Systems that are used to support the heating coil elements of the electrical resistance heating assemblies are also well know in the art. Typically, the systems that are utilized to support the electric resistance heating assemblies comprise a metal rack that includes a series of support rods or bars. In order to support the heating elements, the frame of the heating element is placed in contact with the support bar and a plurality of rivets are used to fix each individual heating element to the support structure.

The systems and brackets heretofore known for supporting electric resistance heating assemblies, while structurally sound and efficient, nevertheless are difficult and time-consuming to manufacture. The difficulty and time-consumption translate to a labor-intensive manufacturing process. Of course, the labor intensive nature of the manufacturing process translates to high costs of manufacture.

In addition, the traditional methods of supporting electric resistance heating assemblies present difficulties in those instances when repair of the assemblies is necessary. Most notably, the metal racks of the prior art comprise a plurality of support bars riveted to a plurality of heating coil elements. In the event that repair can be accomplished by the replacement of a single heating coil, the prior art methods require the removal of the rivets from one section of the metal rack, thereby making the repair process long and difficult.

OBJECTS AND SUMMARY OF THE INVENTION

It is therefore an object of the present invention to provide an improved mounting system for supporting an electric resistance heating assembly.

It is another object of the present invention to provide an improved mounting system for supporting an electric resistance heating assembly that is easy and relatively low in cost to manufacture.

It is yet another object of the present invention to provide an improved mounting system for supporting an electric resistance heating assembly that provides an easier method of repairing electric resistance heating assemblies.

These and other objects are attained by providing an electric element mounting system including a housing and at least one heating element. Each element includes a frame having a longitudinal axis and a distal end, a heating coil and a wire terminal for electrically and mechanically coupling the element to the front panel. A substantially planar mounting bracket is located within the housing, the bracket including at least one aperture. The bracket is located within the housing and placed in a plane perpendicular to the longitudinal axis of said frame so that the distal end is placed through the aperture to mount the element upon the bracket.

DESCRIPTION OF THE PREFERRED EMBODIMENT

Figure 1:
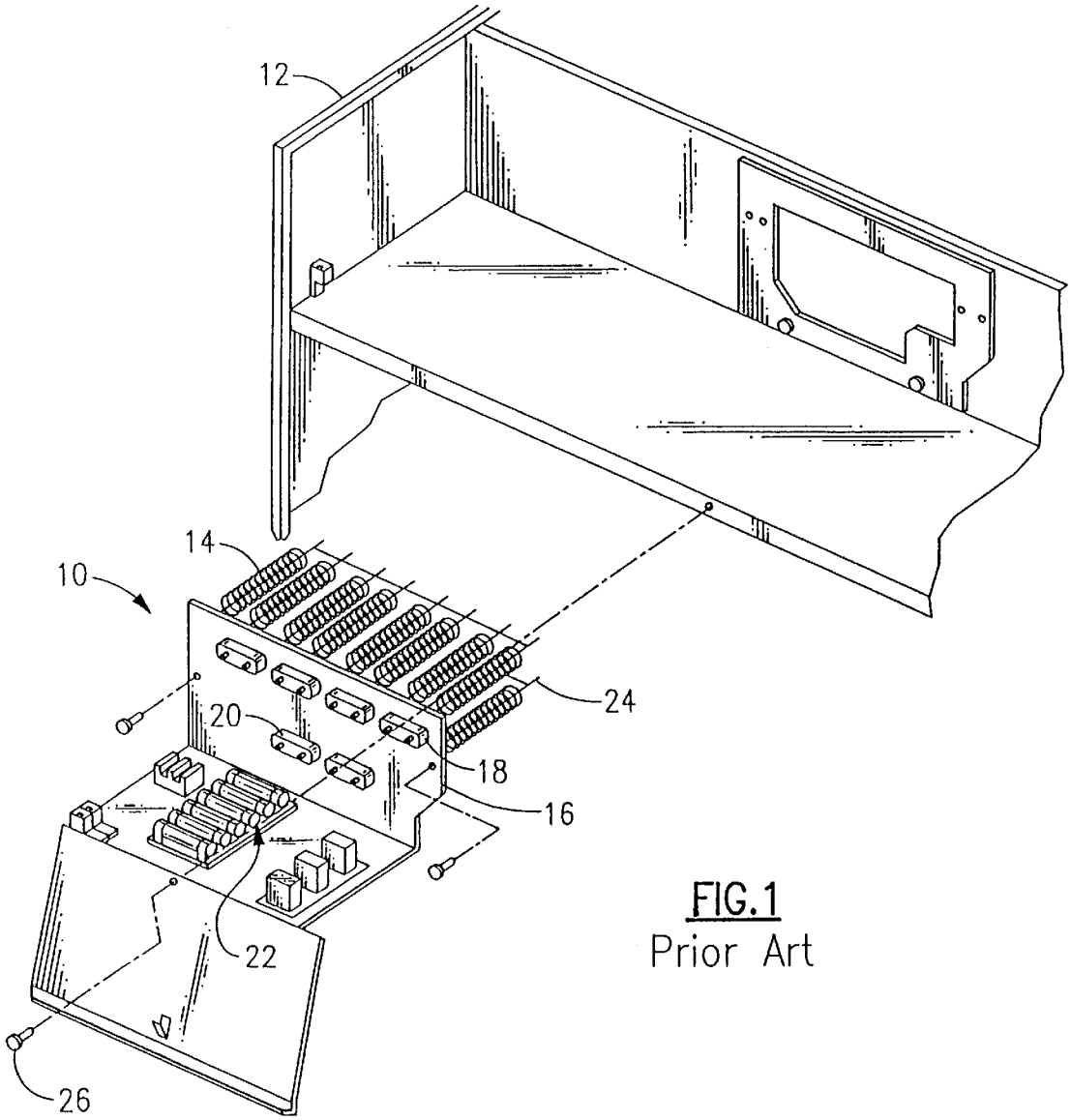
FIG.1 Prior Art
FIG. 1 is a partially exploded plan view of an electric resistance heating assembly using a prior art method of supporting the heating coil elements.

Referring now to FIG. 1, there is shown a prior art method of mounting an electric resistance heating assembly 10 within a housing 12. There are a plurality of heating coil elements 14 that are coupled to a heating assembly front panel 16. The heating coil elements 14, as is well known in the art, include a metal frame with a resistance coil mounted thereon and a wire terminal 18 with a corresponding insulator 20. The wire terminal 18 and insulator 20 are used in conjunction with other well known fastening methods to electrically and mechanically couple the heating elements 14 to the panel 16. The panel 16 includes fuses 22 and other required electronics to supply the necessary electrical currents to the individual heating coil elements 14, as is well known in the art. The heating coil elements 14 are attached at their distal end to a support structure 24. The support structure 24 comprises a number of metal bars that are coupled to each other. The support structure 24 is coupled to each respective heating coil element 14 by riveting the distal end of the element 14 to one of the metal bars of the support structure 24. In this way, the support structure 24 is attached to each of the elements 14 and forms an interconnected framework of metal bars. The entire heating assembly 10 is coupled by well known methods to the housing 12, such as a sheet metal screw 26.

Figure 2:
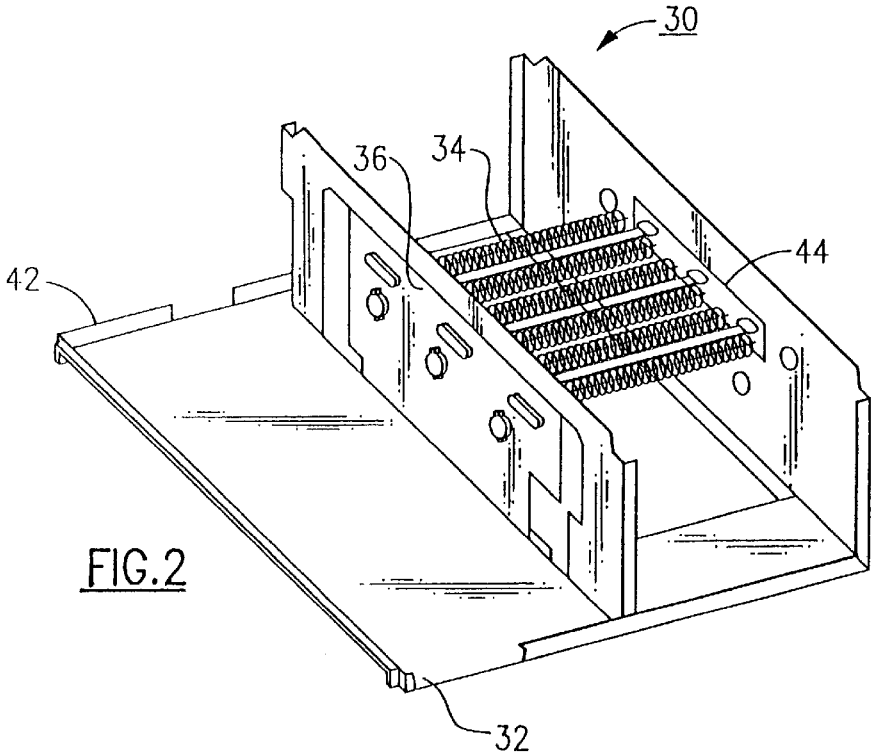
FIG. 2 is a plan view of an electric resistance heating assembly that utilizes a mounting bracket system that embodies the present invention.

Turning now to FIG. 2, there is shown an electric resistance heating assembly 30 within a housing 32 that is mounted utilizing the mounting system of the present invention. The heating assembly 30 includes a plurality of heating coil elements 34. The heating coil elements 34 are electrically and mechanically coupled to a heating assembly front panel 36, as will be explained in more detail below. The panel 36 includes fuses 42 and other required electronics to supply the necessary electrical currents to the individual heating coil elements 34. The heating coil elements 34 are coupled to a mounting bracket 44 that is located within the housing 32, as will be explained in more detail below.

Figure 3:
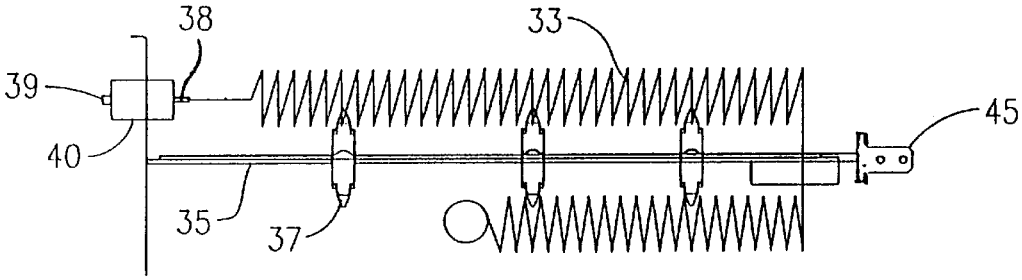
FIG. 3 is a side elevation view of a electric resistance heating element and bracket therefore that embodies the present invention.

Referring to FIG. 3, there is depicted a heating coil element assembly that includes a frame 35 having a longitudinal axis. The heating coil element 3 further includes a heating coil 33 which is supported by frame insulators 37, a wire terminal 38, and an insulator 40. At the proximal end of the frame 35, there is located a sheet metal screw 39 that is used to fasten the heating coil element to the panel 36. One skilled in the art would recognize that there are many suitable fasteners, wire terminals, and insulators that would suffice to electrically and mechanically couple the heating coil element 34 to the panel 36. At the distal end of the frame 35, there is located a tab 45 that is used to secure the heating coil element to the mounting bracket 44, as will be explained in greater detail below. As is depicted in FIG. 3, the tab 45 is preferably rectangularly shaped at the most distal point with a narrower portion immediately adjacent to the frame 35.

Figure 4A:
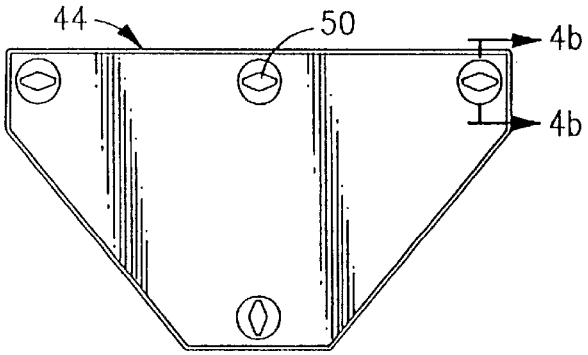
FIG. 4*a* is a front elevation view of a mounting bracket that embodies the present invention.
Figure 4B:
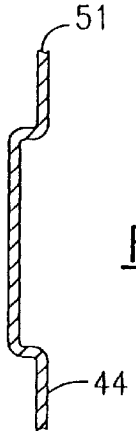
FIG. 4*b* is a cross-sectional view along line 4*b*—4*b* of FIG. 4.

Referring now to FIG. 4, there is shown the mounting bracket 44 of the present invention. The bracket 44 is substantially planar and is constructed of a strong and durable material, preferably sheet metal. The bracket 44 includes a plurality of apertures 50. The number of apertures 50 coincides with the number of heating coil elements. Typically, there are three, four or six apertures on the bracket 44. The apertures 50 are spaced about the planar surface of the bracket 44 to allow placement of the distal end of the heating coil elements into the apertures 50 so that the heating coil elements have sufficient space relative to each other. In the preferred embodiment, the apertures 50 are diamond-shaped, with one axis longer than other axis. The longer axis is sized to accept the rectangular portion of the tab 45 of the heating coil element 34. In addition, in the preferred embodiment, the aperture 50 is recessed into the front planar surface 51, as is depicted in FIG. 4*b*.

Figure 6:
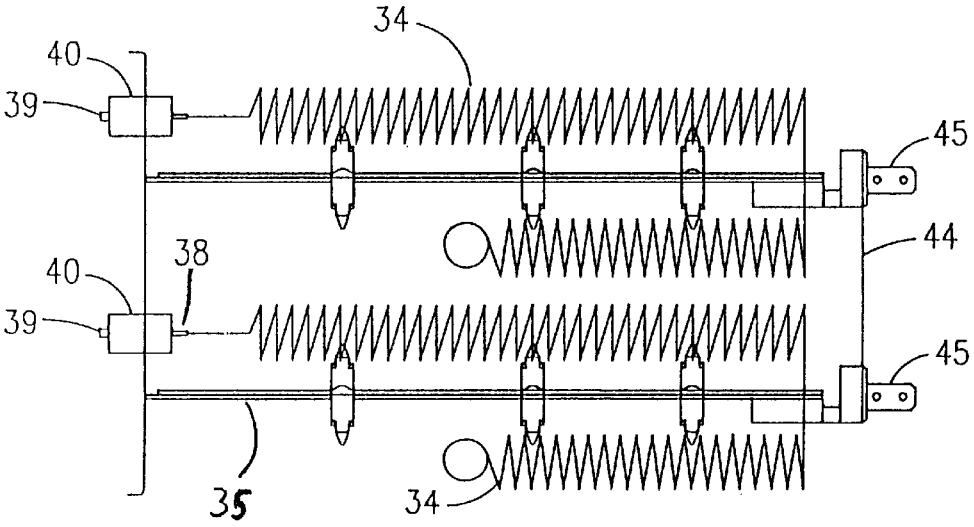
FIG. 6 is a side elevation view of an electric resistance heating assembly that utilizes a mounting bracket system that embodies the present invention.

Referring now to FIG. 6, the heating coil elements are shown with the tab 45 inserted into the bracket 44. The bracket 44 is situated with the front planar surface 51 located in a plane that is perpendicular to the longitudinal axis of the heating coil elements. The proximal end of the frame 35 including the wire terminal 38 is electrically and mechanically coupled to the panel 36. The insulator 40 is placed in contact with the wire terminal 38 and the proximal end of the frame 35 is mechanically coupled to the panel 36 using a sheet metal screw 39, as described above.

Figure 3A:
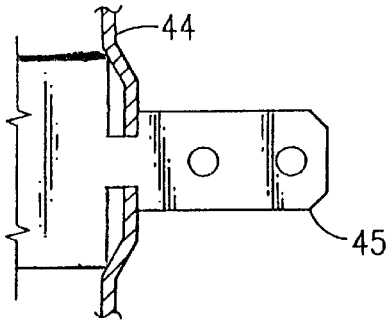
FIG. 3*a* is a side elevation view of a portion of the mounting bracket of the present invention.
Figure 7:
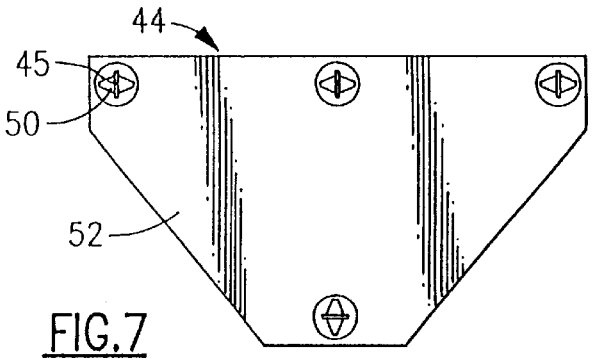
FIG. 7 is a rear elevation view of a mounting bracket that embodies the present invention.

During installation, the tab 45 is passed through the aperture 50 with the rectangular portion of the tab 45 passing through the longer axis of the diamond-shaped aperture 50. When the entire rectangular portion of the tab 45 has passed through the aperture, the heating coil element is rotated so that the rectangular portion of the tab 45 rotates into a position that does not allow removal of the heating coil element from the bracket 44 because the tab 45 cannot pass through the smaller axis of the diamond-shaped aperture 50. In the preferred embodiment, the heating coil element must be rotated at least 15 degrees and preferably is rotated 90 degrees. Referring to FIG. 7, the rear side 52 of the bracket 44 is shown with the tabs 45 of the heating coil elements 34 in place. As depicted in FIGS. 3*a* and 7, the heating coil elements have been rotated 90 degrees.

The mounting bracket of the present invention is significantly easier to manufacture than prior art devices. It is a single piece and is preferably manufactured from sheet metal. Contrary to prior art devices, there is no need to use rivets to fasten the heating coil elements to the bracket and therefore the manufacture of the mounting structure and the entire heating assembly is much easier. In addition, a repair of a single element in a two-element heater only requires the removal of the screw from the front panel and a counter rotation of the element to remove it from the mounting bracket. There is no need to disassemble the entire support structure to replace only one element. Large heaters with multiple elements may require loosening some screws to remove an element.

Of course, the foregoing description is directed to particular embodiments of the present invention and various modifications and other embodiments of the present invention will be readily apparent to one skilled in the art to which the present invention pertains. Therefore, while the present invention has been described in conjunction with these particular embodiments, it is to be understood that various modifications and other embodiments of the present invention may be made without departing from the scope of the invention described herein and as claimed in the appended claims.

We claim:

1. An electric element mounting system comprising:

a housing;

a heating assembly having a front panel located within said housing;

at least one heating element, each said element including a frame having a longitudinal axis and a distal end, a heating coil, and a wire terminal for electrically and mechanically coupling said element to said panel;

a substantially planar mounting bracket located within said housing, said bracket including at least one aperture, said bracket located within said housing and placed in a plane perpendicular to the longitudinal axis of said frame;

wherein said distal end is placed through said aperture to mount said element upon said bracket.

2. The mounting system of claim 1 wherein said aperture is entirely contained within a recess located on said planar mounting bracket.

3. The mounting system of claim 1 wherein said aperture is diamond-shaped.

4. The mounting system of claim 1 wherein said distal end comprises a tab.

5. The mounting system of claim 1 wherein said aperture is entirely contained within a recess located on said planar mounting bracket, said aperture is diamond-shaped and said distal end comprises a tab.

6. The mounting system of claim 5 wherein said distal end is initially placed through said aperture and then said frame is rotated between at least 15 degrees to securely mount said element upon said bracket.

7. The mounting system of claim 1 further comprising fastening means for securing said wire terminal to said panel.

8. The mounting system of claim 7 wherein said fastening means comprises a metal sheet screw.

9. A method of mounting a plurality of heating coil elements in an electrical resistance heating assembly, said method comprising providing a housing;

providing a heating assembly including a front panel located within said housing;

providing at least one heating element, each said element including a frame having a longitudinal axis and a distal end, a heating coil, and a wire terminal for electrically and mechanically coupling said element to said panel;

providing a substantially planar mounting bracket located within said housing, said bracket including at least one aperture, said bracket located within said housing and placed in a plane perpendicular to the longitudinal axis of said frame;

placing said distal end through said aperture to mount said element upon said bracket.

10. The method of claim 9 wherein said aperture is entirely contained within a recess located on said planar mounting bracket.

11. The method of claim 9 wherein said aperture is diamond-shaped.

12. The method of claim 9 wherein said distal end comprises a tab.

13. The method of claim 9 wherein said aperture is entirely contained within a recess located on said planar mounting bracket, said aperture is diamond-shaped and said distal end comprises a tab.

14. The method of claim 13 wherein said distal end is initially placed through said aperture and then said frame is rotated between at least 15 degrees to securely mount said element upon said bracket.

15. The method of claim 9 further comprising providing a fastening means to fasten said wire terminal to said panel.

16. The method of claim 15 wherein said fastening means comprises a metal sheet screw.

* * * * *